US009267459B2

(12) United States Patent
Nakata et al.

(10) Patent No.: US 9,267,459 B2
(45) Date of Patent: Feb. 23, 2016

(54) FUEL-INJECTOR-REPLACEMENT DETERMINING DEVICE

(75) Inventors: Kenichiro Nakata, Okazaki (JP); Koji Ishizuka, Chita-gun (JP)

(73) Assignee: DENSO CORPORATION, Kariya (JP)

( * ) Notice: Subject to any disclaimer, the term of this patent is extended or adjusted under 35 U.S.C. 154(b) by 989 days.

(21) Appl. No.: 13/161,740

(22) Filed: Jun. 16, 2011

(65) Prior Publication Data

US 2011/0313728 A1 Dec. 22, 2011

(30) Foreign Application Priority Data

Jun. 18, 2010 (JP) ..... 2010-139476

(51) Int. Cl.
*F02D 41/20* (2006.01)
*F02D 41/24* (2006.01)

(52) U.S. Cl.
CPC ..... *F02D 41/2096* (2013.01); *F02D 41/2441* (2013.01); *F02D 2041/2086* (2013.01)

(58) Field of Classification Search
CPC ..... F02D 2041/2086; F02D 41/2096; F02D 41/2441
USPC ..... 702/184
See application file for complete search history.

(56) References Cited

U.S. PATENT DOCUMENTS

| | | | | |
|---|---|---|---|---|
| 6,062,198 | A | 5/2000 | Loehr | |
| 2003/0130784 | A1 * | 7/2003 | Peltier | 701/104 |
| 2008/0059038 | A1 | 3/2008 | Yoshida et al. | |
| 2009/0056676 | A1 | 3/2009 | Nakata et al. | |
| 2009/0063013 | A1 | 3/2009 | Nakata et al. | |
| 2009/0265076 | A1 * | 10/2009 | Hirose | 701/103 |

FOREIGN PATENT DOCUMENTS

| | | |
|---|---|---|
| JP | 8-284730 | 10/1996 |
| JP | P2006-226269 A | 8/2006 |

OTHER PUBLICATIONS

Japanese Office Action dated Jun. 5, 2012, issued in corresponding Japanese Application No. 2010-139476 with English translation.

* cited by examiner

*Primary Examiner* — Gregory J Toatley
*Assistant Examiner* — Yoshihisa Ishizuka
(74) *Attorney, Agent, or Firm* — Nixon & Vanderhye P.C.

(57) ABSTRACT

A fuel-injector-replacement device obtains a learning value of characteristic data of an injector while an engine is running. The learning value stored in an ECU is updated into the learning value. When the engine is stopped, the characteristic data stored in an INJ-EEPROM are updated into the characteristic data stored in the ECU. When the engine is started, it is determined whether the characteristic data stored in the ECU agrees with the characteristic data stored in the INJ-EEPROM. When these data do not agree with each other, it is determined that the fuel-injector is improperly replaced without updating the characteristic data stored in the ECU.

6 Claims, 3 Drawing Sheets

FUEL-INJECTOR-REPLACEMENT DETERMINING DEVICE

CROSS-REFERENCE TO RELATED APPLICATION

This application is based on Japanese Patent Application No. 2010-139476 filed on Jun. 18, 2010, the disclosure of which is incorporated herein by reference.

FIELD OF THE INVENTION

The present invention relates to a fuel-injector-replacement determining device which determines whether a fuel-injector for an internal combustion engine is replaced.

BACKGROUND OF THE INVENTION

JP-2009-57926A (US-2009/0056676A1) describes that a variation in fuel pressure due to a fuel injection through a fuel-injector is detected, and an actual fuel-injection-start timing and an actual fuel injection quantity are detected based on the detected fuel pressure waveform. For example, the actual fuel-injection-start timing is detected based on a fuel-pressure-drop-start point appearing on the fuel pressure waveform. The actual fuel injection quantity is detected based on the fuel-pressure-drop quantity. As above, if the actual fuel injection condition is detected, the fuel injection condition can be accurately controlled based on the detected fuel injection condition.

However, a correlation between the fuel-pressure-drop-start point and the actual fuel-injection-start timing and a correlation between the fuel-pressure-drop quantity and the actual fuel injection quantity are specific values in each fuel-injector. In JP-2009-57926A, such specific values (characteristic data) are previously experimentally obtained. These obtained characteristic data are stored in a memory provided to the fuel-injector. This memory provided to the fuel-injector will be referred to as an INJ-memory hereinafter. Then, before shipping the internal combustion engine, the characteristic data stored in the INJ-memory are transferred to a memory provided to an ECU. This memory provided to the ECU is referred to as an ECU-memory hereinafter. After the internal combustion engine is shipped into the market, an operation of the fuel-injector is controlled based on the characteristic data stored in the ECU-memory.

When the fuel-injector is replaced by new one after shipping the internal combustion engine, it is necessary that characteristic data of the new fuel-injector are transferred to the ECU to be stored in the ECU-memory (controller-memory means). However, if the fuel-injector is replaced by new one without changing the characteristic date stored in the ECU-memory into new data of the new fuel-injector, the new fuel-injector is operated based on the old characteristic data. Thus, the fuel injection condition can not be controlled with high accuracy.

SUMMARY OF THE INVENTION

The present invention is made in view of the above matters, and it is an object of the present invention to provide a fuel-injector-replacement determining device capable of determining whether a fuel-injector is replaced without updating characteristic data stored in a controller-memory means.

According to the present invention, a fuel-injector-replacement determining device is applied to a fuel injection system which includes a fuel-injector for injecting a fuel into an internal combustion engine, an electronic control unit controlling an operation of the fuel-injector based on characteristic data of the fuel-injector, an injector-memory means provided to the fuel-injector, and a controller-memory means provided to the electronic control unit.

The fuel-injector-replacement determining device includes a learning means for obtaining a learning value of the characteristic data and for updating the characteristic data stored in the controller-memory means into the learning value while the engine is running; an updating means for updating the characteristic data stored in the injector-memory means into the characteristic data stored in the controller-memory means; a collation means for determining whether the characteristic data stored in the controller-memory means are consistent with the characteristic data stored in the injector-memory means when the internal combustion engine is started; and a replacement determination means for determining that the fuel-injector is replaced without updating the characteristic data stored in the controller-memory means when the collation means determines that characteristic data stored in the controller-memory means are not consistent with the characteristic data stored in the injector-memory means.

According to the above invention, even if the characteristic date of the fuel-injector is varied due to its aging deterioration, the learning means updates the characteristic data into the learning value. Thus, when the fuel-injector is controlled based on the characteristic data, a control accuracy of the fuel-injection condition can be improved.

Further, when the engine is stopped, the characteristic data stored in the injector-memory means is updated. If the fuel-injector is improperly replaced while the engine is stopped, it is determined that the characteristic data stored in the controller-memory means are not consistent with the characteristic data stored in the injector-memory means when the engine is restarted. According to the present invention, when the characteristic data stored in the controller-memory means are not consistent with the characteristic data stored in the injector-memory means, the replacement determination means determines that the fuel-injector is improperly replaced without updating the characteristic data stored in the controller-memory means.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Hereinafter, an embodiment of the present invention will be described. A fuel-injector-replacement determining device is applied to an internal combustion engine 100 (diesel engine) having four cylinders #1-#4.

Figure 1:
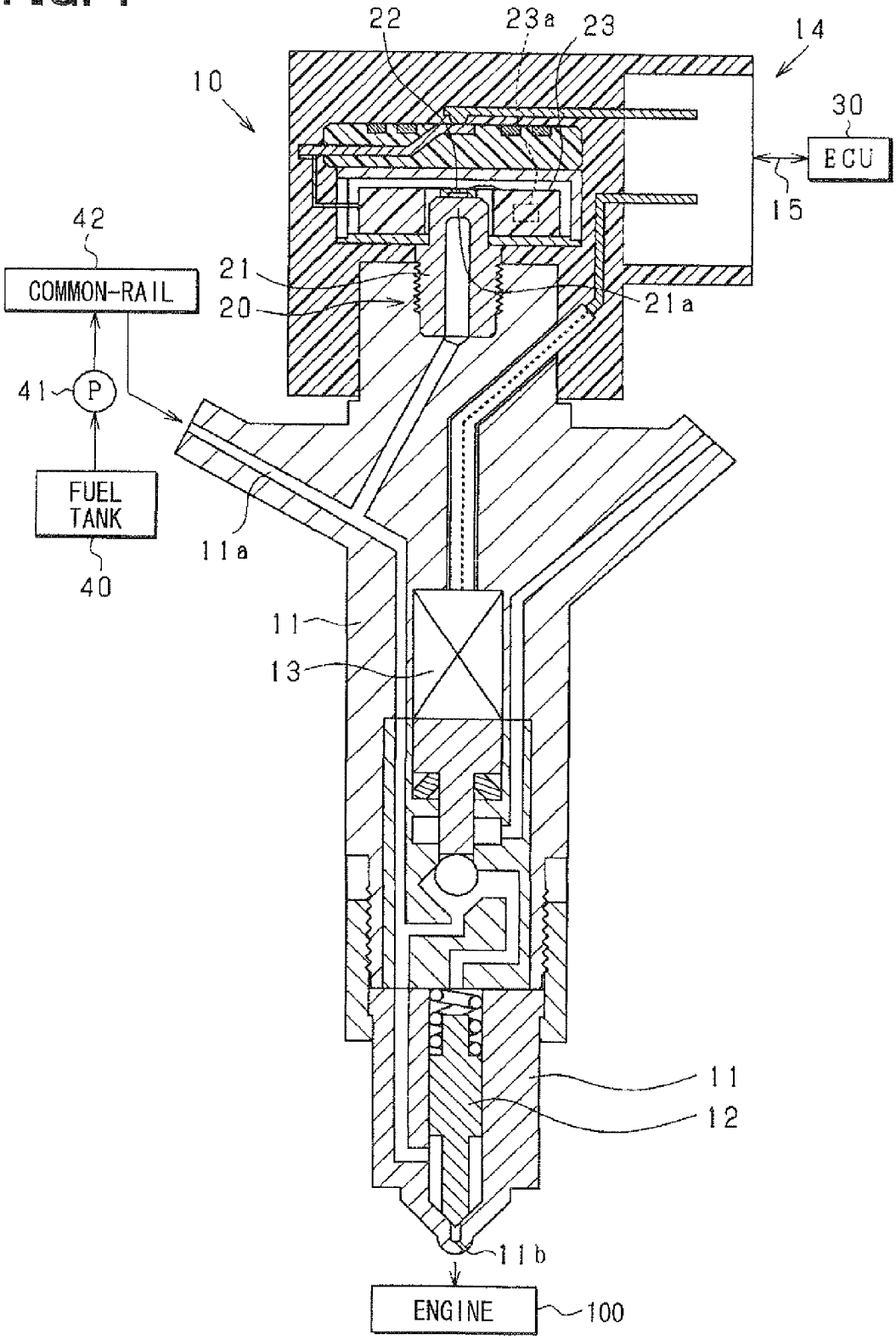
FIG. 1 is a schematic view showing a fuel injection system including a fuel-injector according to an embodiment of the present invention.

FIG. 1 is a schematic view showing a fuel-injector 10 provided to each cylinder, a fuel pressure sensor 20 provided on the fuel-injector 10, and an electronic control unit (ECU) 30.

First, a fuel injection system of the engine 100 including the fuel-injector 10 will be explained. A fuel in a fuel tank 40 is pumped up by a high-pressure pump 41 and is accumulated in a common-rail 42 to be supplied to each injector 10.

The fuel-injector 10 is comprised of a body 11, a needle (valve body) 12, an actuator 13 and the like. The body 11 defines a high pressure passage 11*a* and an injection port 11*b*. The needle 12 is accommodated in the body 11 to open/close the injection port 11*b*. The actuator 13 drives the needle 12. The ECU 30 controls the actuator 13 to drive the needle 12. When the needle 12 opens the injection port 11*b*, high-pressure fuel in the high pressure passage 11*a* is injected to a combustion chamber (not shown) of the engine 100. The ECU 30 computes a target fuel-injection condition, such as a fuel injection start timing, a fuel injection end timing, a fuel injection quantity and the like based on an engine speed, an engine load and the like. The ECU 30 transmits a fuel-injection-command signal to the actuator 13 in order to drive the needle 12 in such a manner as to obtain the above target fuel-injection condition.

A structure of the fuel pressure sensor 20 will be described hereinafter.

The fuel pressure sensor 20 includes a stem (load cell), a pressure sensor element 22 and a molded IC 23. The stem 21 is provided to the body 11. The stem 21 has a diaphragm 21*a* which elastically deforms in response to high fuel pressure in the high pressure passage 11*a*. The pressure sensor element 22 is disposed on the diaphragm 21*a* to output a pressure detection signal depending on an elastic deformation of the diaphragm 21*a*.

The molded IC 23 includes an amplifying circuit which amplifies the pressure detection signal outputted from the pressure sensor element 22. Further, the molded IC 23 includes an EEPROM 23*a* which is a rewritable nonvolatile memory. This EEPROM 23*a* corresponds to an INJ-memory. A connector 14 is provided on the body 11. The molded IC 23, the actuator 13 and the ECU 30 are electrically connected to each other through a harness 15 connected to the connector 14.

When the fuel injection is started, the fuel pressure in the high pressure passage 11*a* starts to decrease. When the fuel injection is terminated, the fuel pressure in the high pressure passage 11*a* starts to increase. That is, a variation in the fuel pressure and a variation in the injection rate have a correlation, so that the variation in the injection rate (actual fuel-injection condition) can be detected from the variation in the fuel pressure. The fuel-injection-command signal is corrected so that the detected actual fuel-injection condition agrees with the target fuel-injection condition. Thereby, the fuel-injection condition can be controlled with high accuracy.

Referring to FIGS, 2A to 2C, a correlation between the variation in fuel pressure detected by the fuel sensor 20 and the variation in fuel injection rate will be described.

Figure 2A:
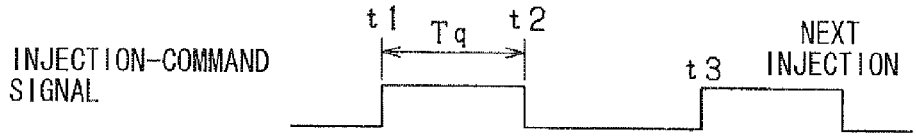
FIG. 2A is a time chart showing a fuel-injection-command signal.

FIG. 2A shows fuel-injection-command signals which the ECU 30 outputs to the actuator 13. Based on this injection-command signal, the actuator 13 operates to open the injection port 11*b*. That is, a fuel injection is started at a pulse-on timing "t1" of the injection-command signal, and the fuel injection is terminated at a pulse-off timing "t2" of the injection-command signal. During a time period "Tq" from the timing "t1" to the timing "t2", the injection hole 11*b* is opened. By controlling the time period "Tq", the fuel injection quantity "Q" is controlled.

Figure 2B:
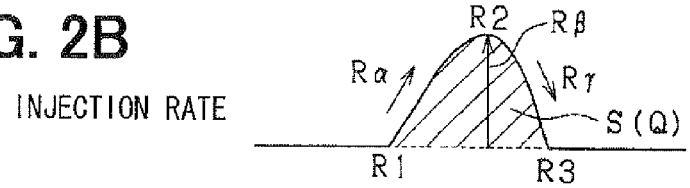
FIG. 2B is a time chart showing a variation in fuel-injection rate.
Figure 2C:
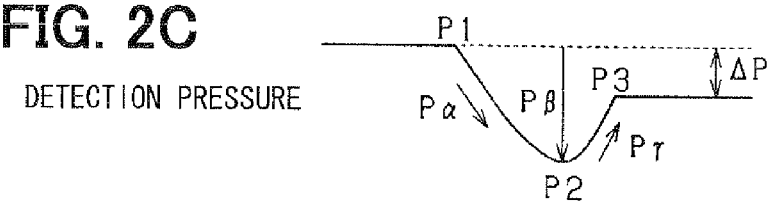
FIG. 2C is a time chart showing a detection pressure detected by a fuel-pressure sensor.

FIG. 2B shows a waveform of variation in fuel injection rate and FIG. 2C shows a waveform of variation in detection pressure. Since the variation in the detection pressure and the variation in the injection rate have a relationship described below, a waveform of the injection rate can be estimated (detected) based on a waveform of the detection pressure.

That is, as shown in FIG. 2A, after the injection command signal rises at the timing "t1", the fuel injection is started and the injection rate starts to increase at a timing "R1". When the injection rate starts to increase at the timing "R1", the detection pressure starts to decrease at a point "P1". Then, when the injection rate reaches the maximum injection rate at a timing "R2", the detection pressure drop is stopped at a point "P2". When the injection rate starts to decrease at a timing "R2", the detection pressure starts to increase at the point "P2". Then, when the injection rate becomes zero and the actual fuel injection is terminated at a timing "R3", the increase in the detection pressure is stopped at a point "P3".

As described above, by detecting the points "P1" and "P3", the actual fuel-injection-start timing "R1" and the actual fuel-injection-end timing "R3" can be computed. Based on a relationship between the variation in the detection pressure and the variation in the fuel injection rate, which will be described below, the variation in the fuel injection rate can be estimated from the variation in the detection pressure.

That is, a decreasing rate "Pα" of the detection pressure from the point "P1" to the point "P2" has a correlation with an increasing rate "Rα" of the injection rate from the timing "R1" to the timing "R2". An increasing rate "Pγ" of the detection pressure from the point "P2" to the point "P3" has a correlation with a decreasing rate "Rγ" of the injection rate from the timing "R2" to the timing "R3". A maximum fuel-pressure-drop amount "Pβ" of the detected pressure has a correlation with a maximum injection rate "Rβ", Therefore, the increasing rate "Rα" of the injection rate, the decreasing rate "Rγ" of the injection rate and the maximum injection rate "Rβ" can be computed by detecting the decreasing rate "Pα" of the detection pressure, the increasing rate "Pγ" of the detection pressure and the maximum fuel-pressure-drop amount "Pβ" of the detection pressure. The variation in the injection rate (variation waveform) shown in FIG. 2B can be estimated by computing the timings "R1", "R3", the rates "Rα", "Rγ" and the maximum injection rate "Rβ".

Furthermore, an integral value "S" of the injection rate from the timing "R1" to the timing "R3" (shaded area in FIG. 23) is equivalent to the injection quantity "Q". An integral value of the detection pressure from the point "P1" to the point "P3" has a correlation with the integral value "S" of the injection rate. Thus, the integral value "S" of the injection rate, which corresponds to the injection quantity "Q", can be computed by computing the integral value of detection pressure.

The ECU 30 has a microcomputer 31 which computes a target fuel-injection condition based on engine load and engine speed, which are derived from an accelerator position. For example, the microcomputer 31 stores an optimum fuel-injection condition (number of stages of fuel injection, fuel-injection-start timing, fuel-injection-end timing, fuel injection quantity and the like) with respect to the engine load and the engine speed as a fuel-injection condition map. Then, based on the current engine load and engine speed, the target fuel-injection condition is computed in view of the fuel-injection condition map.

Then, based on the computed target fuel-injection condition, the fuel-injection-command signal represented by "t1", "t2", "Tq" is established. For example, the fuel-injection-command signal corresponding to the target fuel-injection condition is stored in a command map. Based on the computed target fuel-injection condition, the fuel-injection-command signal is established in view of the command map. As above, according to the engine load and the engine speed, the fuel-injection-command signal is established to be output to the injector 10.

It should be noted that the actual fuel-injection condition varies relative to the fuel-injection-command signal due to aging deterioration of the fuel-injector 10, such as abrasion of the injection hole 11*b*. In the present embodiment, a relationship between the fuel-injection-command signal ("t1", "t2", "tq") and the fuel-injection condition ("R1", "R3", "Rα", "Rβ", "Rγ", "Q") is learned and stored as the specific characteristic data of the fuel-injector 10. Then, based on the learned characteristic data, the fuel-injection-command signal stored in the command map is corrected. Thus, the fuel-injection condition can be accurately controlled so that the actual fuel-injection condition agrees with the target fuel-injection condition.

The actual fuel-injection-start timing "R1" can be learned as the response delay between the pulse-on timing "t1" and the actual fuel-injection-start timing "R1". Also, the timings "R1" and "R3" can be learned as the fuel injection period.

Figure 3:
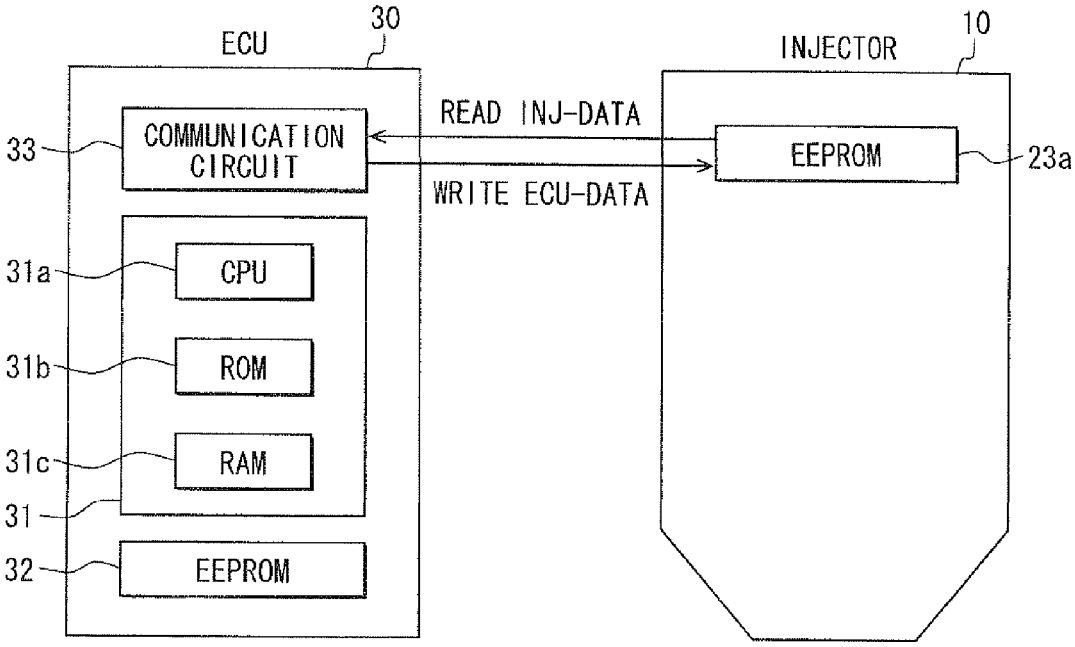
FIG. 3 is a block diagram showing the fuel injection controller.

The fuel-pressure-drop ΔP from "P1" to "P3" can be learned as the control parameter As shown in FIG. 3, the ECU 30 includes a microcomputer 31, an electrically erasable programmable read-only memory (EEPROM) 32, and a communication circuit 33. The EEPROM 32 is referred to as an ECU-EEPROM 32. The communication circuit 33 functions as a communication interface. The microcomputer 31 includes a CPU 31*a*, a ROM 31*b*, and a RAM 31*c*. Besides, the ECU-EEPROM 32 and the RAM 31*c* correspond to a controller-memory means.

Initial values of the characteristic data described above are previously obtained by experiments before the injector 10 is shipped into the market. These initial values of the characteristic data are stored in the EEPROM 23*a* provided to the injector 10 before shipping. The EEPROM 23*a* of the injector 10 is referred to as an INJ-EEPROM 23*a* hereinafter. Moreover, when the engine 100 is shipped into the market, the characteristic data of the injector 10 mounted on the engine 100 is stored in the ECU-EEPROM 32. Hereinafter, the characteristics data stored in the INJ-EEPROM 23*a* are referred to as the INJ-data, and the characteristic data stored in the ECU-EEPROM 32 is referred to as the ECU-data.

Then, after the engine 100 is shipped into the market, the learned characteristic data are temporarily stored in the RAM 31*c* of the microcomputer 31. When the operation of the engine 100 is terminated, these characteristic data are stored in the ECU-EEPROM 32 and the INJ-EEPROM 23*a*.

The communication circuit 33 is electrically connected to the INJ-EEPROM 23*a* in such a manner as to perform two-way communications. The microcomputer 31 can read the INJ-data stored in the INJ-EEPROM 23*a*. Further, the microcomputer 31 can rewrite the INJ-data stored in the INJ-EEPROM 23*a* into the updated characteristic data stored in the RAM 31*c*.

Figure 4:
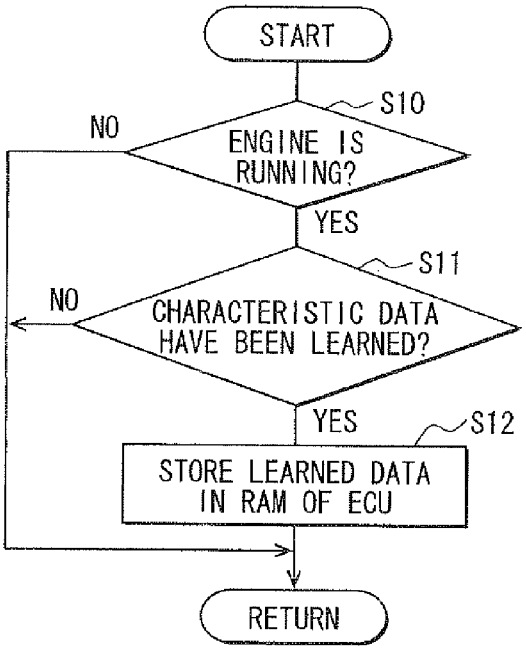
FIG. 4 is a flow chart showing a learning processing of characteristic data.

FIG. 4 is a flowchart showing a learning processing of characteristic data after the engine 100 is shipped into the market. The microcomputer 31 repeatedly executes this processing at a specified interval. In step S10, the computer 31 determines whether the engine 100 is running. When the answer is YES, the procedure proceeds to step S11 in which the computer 31 determines whether the characteristic data have been learned. When the answer is YES in step S11, the procedure proceeds to step S12 (learning means) in which the learned characteristic data is stored in the RAM 31*c* of the ECU 30.

Figure 5:
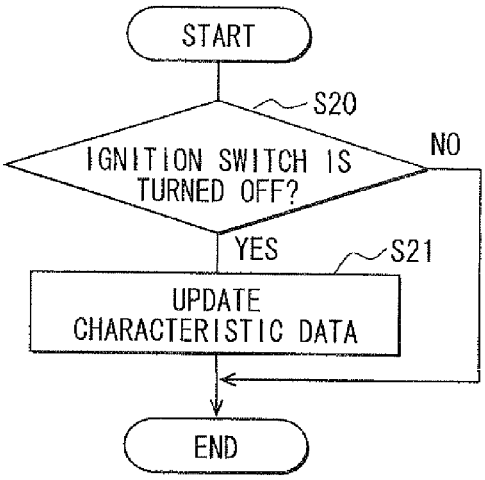
FIG. 5 is a flow chart showing an updating processing of characteristic data.

FIG. 5 is a flowchart showing an updating processing of characteristic data. in step S20, the computer 31 determines whether an ignition switch is turned off. When the answer is YES in step S20, the procedure proceeds to step S21 (updating means) in which the characteristic data stored in the ECU-EEPROM 32 and the INJ-EEPROM 23*a* are rewritten into the learned data stored in the RAM 31*c*. It should be noted that the process in step S21 is executed only once when the ignition switch is turned off.

Since the learned characteristic data are stored in both the ECU-EEPROM 32 and the INJ-EEPROM 23*a*, the characteristic data stored in the INJ-EEPROM 23*a* can be utilized as backup data if the characteristic data stored in the ECU-EEPROM 32 are damaged. By conducting checksum, it can be determined whether the stored characteristic data are damaged.

Specifically, when the ignition switch is turned on to energize the ECU 30, the checksum is conducted with respect to the ECU-data and the INJ-data. When the ECU-data are not damaged, the characteristic data stored in the INJ-EEPROM 23*a* are written in the RAM 31*c*. The microcomputer 31 controls the fuel-injector 10 based on the characteristic date stored in the RAM 31*c*. Meanwhile, if the ECU-data are damaged and the INJ-data are not damaged, the INJ-data are written in the RAM 31*c*. If both of data are damaged, an abnormality-flag is turned on to output an abnormality-signal.

In a case that the fuel-injector 10 is replaced by new one after the engine 100 is shipped into the market, it is necessary that the ECU 30 reads the characteristic data (INJ-data) of new fuel-injector 10 from the INJ-EEPROM 23*a* and the ECU-data stored in the ECU-EEPROM 32 and the RAM 31*c* are updated. However, if the fuel-injector 10 is replaced by new one without updating the characteristic data (improper replacement), the fuel-injector 10 is controlled based on improper characteristic data, which deteriorates a control accuracy of the fuel-injection condition.

Figure 6:
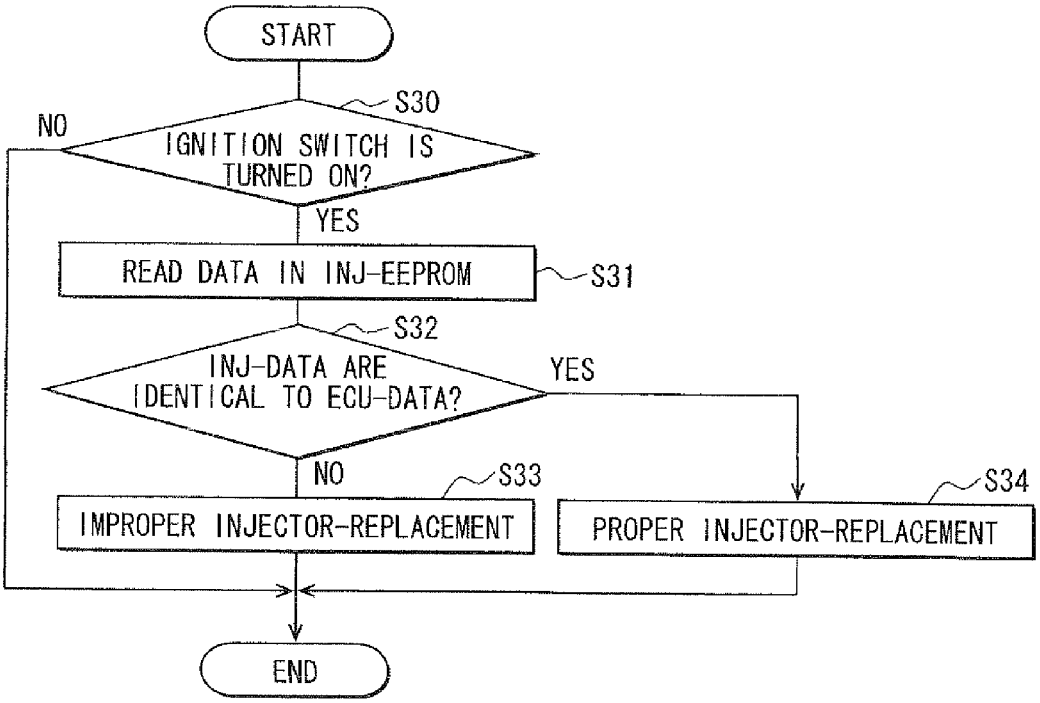
FIG. 6 is a flow chart showing a collation processing of characteristic data.

According to the present embodiment, a determination of an improper replacement of the fuel-injector 10 is conducted as follows. FIG. 6 is a flowchart showing a processing for determining whether the improper replacement of the fuel-injector is conducted. The microcomputer 31 repeatedly executes the processing at specified intervals. In step S30, the computer 31 determines whether an ignition switch is turned on. When the answer is YES, the procedure proceeds to step S31 in which the INJ-data are read from the INJ-EEPROM 23*a*. In step S32 (collation means), the computer 31 determines whether the ECU-data stored in the ECU-EEPROM 32 are consistent with the INJ-data obtained in step S31.

Each of the INJ-data and the ECU-data is comprised of a plurality pieces of data. Specifically, each of the INJ-data and the ECU-data includes a value indicative of a correlation between a pulse-on timing "t1" of the fuel-injection-command signal and the actual fuel-injection-start timing "R1", which corresponds to a response delay time. Further, each of the data includes a value indicative of a correlation between the pulse-on period "Tq" and the actual fuel injection quantity "Q", and a value indicative of the response delay time and a value indicative of (Tq-Q). In step S32, with respect to every data, a collation determination is conducted to determine whether the INJ-data and the ECU-data are identical to each other.

When the answer is YES in step S32, the procedure proceeds to step S34 in which the computer 31 determines that an improper replacement of the fuel-injector 10 is not conducted (normal condition). Meanwhile, when the answer is NO in step S32, the procedure proceeds to step S33 in which the computer determines that an improper replacement of the fuel-injector 10 is conducted. This step corresponds to a replacement determination means.

The processing in steps S31 to S34 is executed only once when the ignition switch is turned on. Besides, the learning processing shown in FIG. 4, the updating processing shown in FIG. 5 and the collation processing shown in FIG. 6 are executed with respect to each of multiple fuel-injectors 10.

As described above, according to the present embodiment, when the ignition switch is turned off to stop the engine 100, the characteristic data stored in the RAM 31*c* are stored also in the INJ-EEPROM 23*a* and the ECU-EEPROM 32. Thus, even if one of data are damaged, the other data can be utilized as the backup data.

When the ignition switch is turned on to start the engine 100, the characteristic data stored in the INJ-EEPROM 23*a* and the ECU-EEPROM 32 are compared with each other. If they are not identical, the computer determines that an improper replacement of the fuel-injector 10 is conducted. Thus, an improper replacement of the fuel-injector 10 is easily detected.

Furthermore, the improper replacement of the fuel-injector 10 is detected by use of the INJ-data which are stored as the backup data. Thus, a special memory for detecting the improper replacement is not necessary, whereby its cost can be reduced.

Since the improper-replacement determination is executed to each of the multiple fuel-injectors, it is less likely that the improper replacement is overlooked.

Since each of multiple data is compared with each other, it is less likely that the improper replacement is overlooked.

[Other Embodiment]

The present invention is not limited to the embodiments described above, but may be performed, for example, in the following manner. Further, the characteristic configuration of each embodiment can be combined.

The INJ-EEPROM 23*a* may be provided to the body 11 or the connector 14.

In the above embodiment, the optimum fuel-injection condition is stored in the fuel-injection condition map. The fuel-injection-command signal corresponding to the target fuel-injection condition is stored in the command map. Then, based on the learned characteristic data, the fuel-injection-command signal stored in the command map is corrected. Alternatively, instead of the fuel-injection condition map and the command map, the optimum fuel-injection-command signal is stored in a map and this signal may be corrected based on the learned characteristic data.

The correction quantity to the fuel-injection-command signal is stored in the EEPROMs 23*a*, 32 as the characteristic data. With respect to this correction quantity, the learning processing shown in FIG. 4, the updating processing shown in FIG. 5 and the collation processing shown in FIG. 6 may be executed.

In the above embodiment shown in FIG. 3, the ECU-EEPROM 32 and the RAM 31*c* correspond to a controller-memory means. While the engine 100 is running, the characteristic data are updated in the RAM 31*c*. After the engine 100 is stopped, the characteristic data are updated in the ECU-EEPROM 32. Alternatively, while the engine 100 is running, the characteristic data may be updated in the ECU-EEPROM 32. It may be configured that only the ECU-EEPROM 32 corresponds to the controller-memory means.

What is claimed is:

1. A fuel-injector-replacement determining device which is applied to a fuel injection system including a fuel-injector for injecting a fuel into an internal combustion engine, an electronic control unit controlling an operation of the fuel-injector based on characteristic data of the fuel-injector, an injector-memory means provided to the fuel-injector, and a controller-memory means provided to the electronic control unit, and a data-update means updating the characteristic data stored in the controller-memory means into the characteristic data stored in the injector-memory means in a case that the fuel-injector is replaced, the fuel-injector-replacement determining device comprising;

a learning means for obtaining a learning value of the characteristic data and for updating the characteristic data stored in the controller-memory means into the learning value while the internal combustion engine is running;

an updating means for updating the characteristic data stored in the injector-memory means into the characteristic data stored in the controller-memory means when an ignition switch is turned off to stop the internal combustion engine;

a collation means for determining whether the characteristic data stored in the controller-memory means are consistent with the characteristic data stored in the injector-memory means when the ignition switch is turned on to start the internal combustion engine; and a replacement determination means for determining that the fuel-injector is replaced without updating the characteristic data stored in the controller-memory means into the characteristic data stored in the injector-memory means when the collation means determines that characteristic data stored in the controller-memory means are not consistent with the characteristic data stored in the injector-memory means.

2. A fuel-injector-replacement determining device according to claim 1, wherein the internal combustion engine is a multi-cylinder internal combustion engine having a plurality of cylinders, the fuel-injector is provided to each of cylinders, the injector-memory means is provided to each of multiple fuel-injectors, the collation means determines whether each of the characteristic data stored in a plurality of controller-memory means are consistent with each of the characteristic data stored in a plurality of injector-memory means, and the replacement determination means determines whether the fuel-injector is replaced without updating the characteristic data stored in the controller-memory means into the characteristic data stored in the injector-memory means with respect to each of the multiple fuel-injectors.

3. A fuel-injector-replacement determining device according to claim 1, wherein the characteristic data includes a plurality of data, and the collation means determines whether each of the characteristic data stored in the controller-memory means are consistent with each of the plurality data stored in the injector-memory means.

4. An control system configured to control an operation of a fuel-injector of an internal combustion engine based on characteristic data of the fuel-injector, the fuel-injector having a memory, the control system comprising:

a memory; and a computer system, including a computer processor, the computer system being configured to:

update the characteristic data stored in the memory of the control system into characteristic data stored in the memory of the fuel injector in a case that the fuel-injector is replaced;

obtain a learning value of the characteristic data and update the characteristic data stored in the memory of the control system into the learning value while the internal combustion engine is running;

update the characteristic data stored in the memory of the fuel injector into the characteristic data stored in the memory of the control system when an ignition switch is turned off to stop the internal combustion engine;

determine whether the characteristic data stored in the memory of the control system are consistent with the characteristic data stored in the memory of the fuel injector when the ignition switch is turned on to start the internal combustion engine; and determine that the fuel-injector is replaced without updating the characteristic data stored in the memory of the control system into the characteristic data stored in the memory of the fuel injector when there is a determination that characteristic data stored in the memory of the control system are not consistent with the characteristic data stored in the memory of the fuel injector.

5. The control system according to claim 4, wherein:

the internal combustion engine is a multi-cylinder internal combustion engine having a plurality of cylinders;

the fuel-injector is provided to each of cylinders; and the memory of the fuel injector is provided to each of multiple fuel-injectors;

the computer system is further configured to:

determine whether each of the characteristic data stored in a plurality of memories of the control system are consistent with each of the characteristic data stored in a plurality of memories of the fuel injector; and determine whether the fuel-injector is replaced without updating the characteristic data stored in the memories of the control system into the characteristic data stored in the memories of the fuel injector with respect to each of the multiple fuel-injectors.

6. The control system according to claim 4, wherein:

the characteristic data includes a plurality of data; and the computer system is further configured to:

determine whether each of the characteristic data stored in the memory of the control system are consistent with each of the plurality data stored in the memory of the fuel injector.

* * * * *